United States Patent [19]

Crosbie

[11] Patent Number: 4,681,290

[45] Date of Patent: Jul. 21, 1987

[54] APPARATUS AND METHOD OF SHORING MASONRY, STONE, CONCRETE AND OTHER MATERIALS OVER OPENINGS IN BUILDINGS

[76] Inventor: Donald A. Crosbie, 11662 Luau La., Cypress, Calif. 90630

[21] Appl. No.: 675,885

[22] Filed: Nov. 28, 1984

[51] Int. Cl.[4] ..... E04G 21/04

[52] U.S. Cl. ..... 248/225.31; 52/127.2; 248/235; 248/242; 248/246

[58] Field of Search ..... 249/299, 211, 24, 25, 249/50; 52/204, 127.2; 248/225.31, 235, 242, 243, 246, 231.5

[56] References Cited

U.S. PATENT DOCUMENTS

| | | | |
|---|---|---|---|
| 4,106,247 | 8/1978 | Svensson | 52/204 |
| 4,192,623 | 3/1980 | Borg | 249/211 |
| 4,304,078 | 12/1981 | Meriwether | 52/127.2 |
| 4,342,440 | 8/1982 | Eyden | 249/24 |
| 4,409,764 | 10/1983 | Wilnau | 52/204 |
| 4,523,414 | 1/1985 | Horgan | 52/204 |

FOREIGN PATENT DOCUMENTS

| | | | |
|---|---|---|---|
| 178456 | 10/1953 | Austria | 249/24 |
| 842258 | 6/1952 | Fed. Rep. of Germany | 52/127.2 |
| 681943 | 5/1930 | France | 52/127.2 |
| 2476725 | 8/1981 | France | 249/50 |
| 172198 | 7/1960 | Sweden | 52/127.2 |
| 708041 | 1/1980 | U.S.S.R. | 52/127.2 |

*Primary Examiner*—Henry E. Raduazo
*Attorney, Agent, or Firm*—John E. Wagner

[57] ABSTRACT

Apparatus and method for aiding in the laying of the top course of bricks over openings in masonry curtain wall construction and other buildings. A clamping hanger securable to the lintel of an opening includes a support foot which extends into the opening. The foot is adjustable in two ways to provide precise temporary support for a soldier bond course of bricks during laying. The hanger does not interfere with construction within or outside of the building while in place. No framing in the opening is required when this hanger and method is used.

11 Claims, 9 Drawing Figures

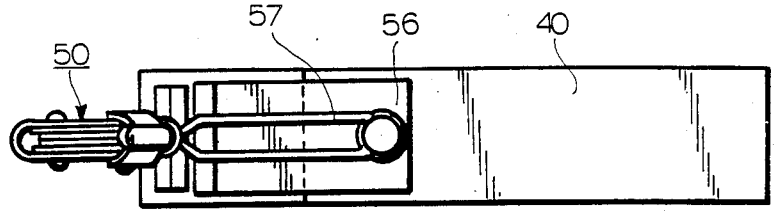
FIG. 3
FIG. 4
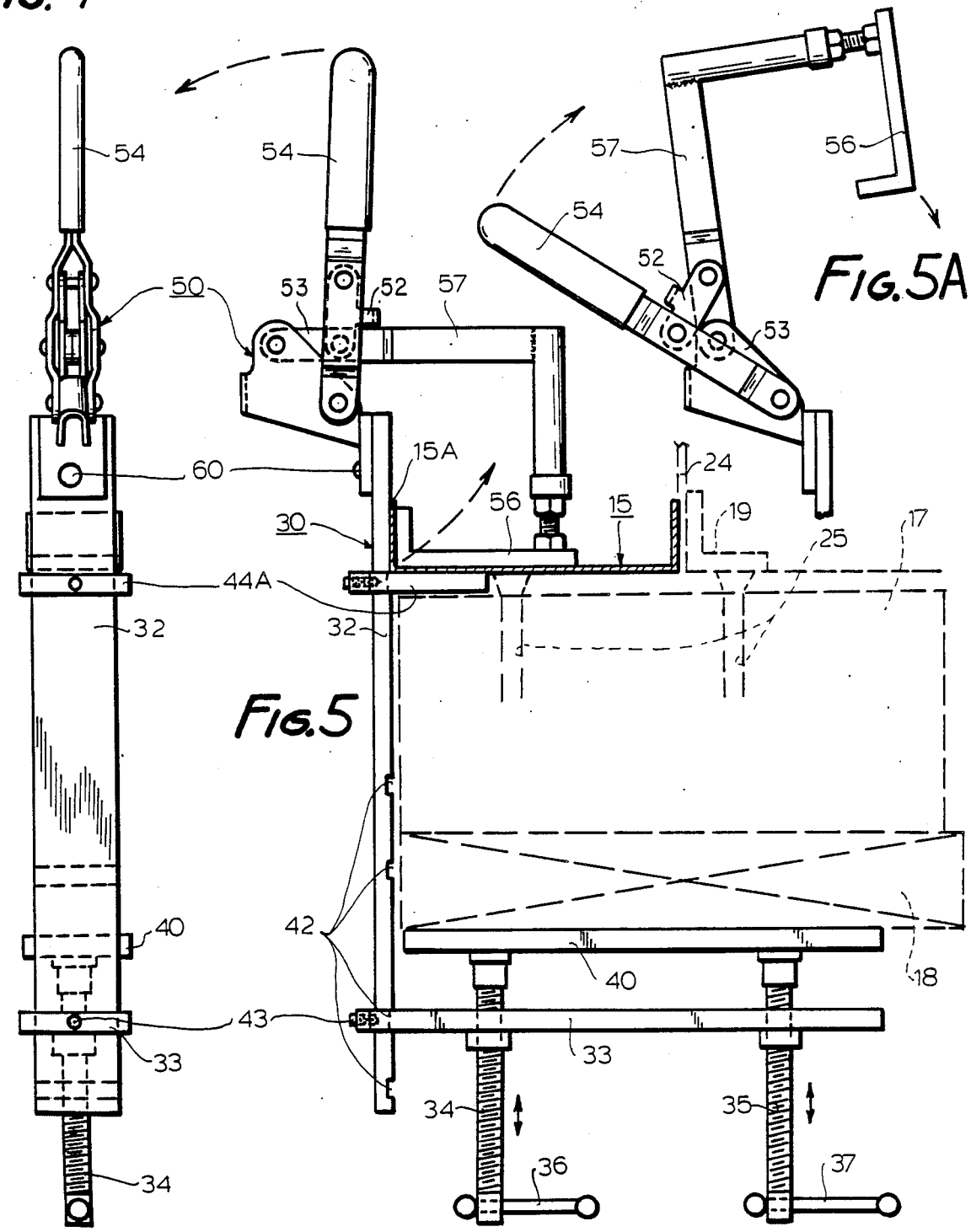
FIG. 5A
FIG. 5

APPARATUS AND METHOD OF SHORING MASONRY, STONE, CONCRETE AND OTHER MATERIALS OVER OPENINGS IN BUILDINGS

Masonry construction is as old as history. It has developed from ancient mud bricks to modern kiln fired bricks. Methods of construction have developed from mortarless joints to laying lime morter filled joints, to steel reinforced masonry construction, and more recently to masonry curtain wall construction of steel buildings.

This last form of construction in which a steel skeleton is erected and a masonry veneer or other type wall secured to the outer face of the steel construction, has gained great popularity in commercial construction. This has occurred since the advantage in cost and relatively unlimited height in commercial construction can be achieved using a steel framework. In the past, masonry construction building has been limited in height, practically speaking, to a few stories. Steel frame construction easily exceeded 60 stories and commonly has used aluminum and glass exterior. Such appearance has been striking and in many cases attractive, while others have given the overall appearance of a mirror factory. Using curtain wall masonry construction, it is possible to have the attractive masonry appearance in a steel skeleton structure of 20 or 30 stories in height and additionally gain the energy saving and long life properties of masonry as compared with aluminum and glass exterior.

One of the attractive accent points of a masonry building is its windows, usually topped by a soldier or rowlock bond single course of bricks and sometimes by a single precast masonry or stone or marble lintel.

I have been involved in masonry construction for over 25 years and from my experience, have found that the top soldier or rowlock bond course of bricks or masonry lintel in a window is usually installed using wood shoring and forms extending from the bottom of the window opening to hold the newly set bricks in place until the mortar has hardened. In a low level building or one with few windows, the cost of placing such shoring and forms in each window opening has been accepted and absorbed as a normal cost of masonry construction. This, in addition to the cost of building and installing shoring and the forms, usually requires that wood shoring remain in place for the masons to install the top course after the full floor level of bricks have been completed and often holds them up from beginning the next floor level of courses of bricks. Again, this has been accepted as a normal procedure in all types of construction.

I have determined however that the cost related to the installation of top course of bricks or the lintel in windows is greatly disproportionate as compared to the remaining masonry, and that a serious need exists for apparatus and method for improving the installation of that course.

BRIEF DESCRIPTION OF THE INVENTION

Faced with the foregoing state of the masonry art, I determined that in masonry curtain wall construction, the top course is invariably located near a horizontal frame member of the steel framework. This frame member will be referred in this application as the support lintel to distinguish if from the decorative lintel which may be the soldier course of bricks, a precast masonry lintel or a stone or marble lintel.

Usually, the support lintel is in the form of a formed channel, legs extending upward and formed of steel sheet in the order of $\frac{1}{8}$ inch in thickness. Usually the support lintel terminates at each window edge at a vertically extending steel stud or column.

It occurred to me that it is possible to define a reference plane for the installation of the top rowlock course of bricks or decorative lintel above the window opening using the support lintel and or the studs adjoining the window opening. This is independent of the bottom of the window opening and no framing in the window opening would be required.

Accordingly, I have devised a clamping support member which is configured to engage the support lintel or side studs and to provide a hanger portion designed to support a single board such as a 2"×12" in the window opening to support the top rowlock course of bricks. My clamp and hanger assembly is independent of the exterior scaffolding used by the masons and does not have to be custom constructed for the windows. Likewise, my clamp and hanger does not obscure the window or interfere with continued construction either in the exterior masonry or interior so that they may be installed ahead of the masons and not interfere with the laying of the normal courses. Masons may remove the hangers after they have completed the single story or other work. They are not slowed by laying the top course of each window opening.

Basically, my hanger combination employs a clamp mechanism, preferably using an overcenter locking clamp, which engages a generally L shaped clamp body with the legs of the window support lintel. Extending below the clamp portion is an L shaped support member dimensioned to extend into the window opening and provide support for a plank such as a "2×12". Two or more clamp and hanger assemblies may be used depending upon the lateral dimension of the window. For windows up to six feet in width, two supports are adequate for laying conventional bricks and placing other materials.

In another embodiment of my invention, the hanger includes a plurality of holes in the L shaped body member instead of the clamp portion. In certain buildings, the framework is so located and of sufficient localized strength that a self-tapping screw may be driven through one or more holes in the body member and into the framework to hold the hanger temporarily while the decorative lintel is laid and its mortar sets. The hanger then may be removed simply by backing out the mounting screws.

In accordance with my method, support means is engaged with the window support lintel and suspended in the window opening. Bricks are laid in soldier or rowlock bond as the top course or the decorative one piece lintel is supported by a laterally extending plank support by the suspended support means until the mortar hardens sufficiently to retain the top course. The support means may then be removed. Construction both within and outside the building is unimpeded.

BRIEF DESCRIPTION OF THE DRAWING

FIG. 3 is a top plan view thereof;

FIG. 4 is a rear elevational view thereof;

FIG. 5 is a side elevational view thereof in locked position with portions of the building structure, brick and support beam shown in phantom;

FIG. 5A is a fragmentary view of the clamping mechanism of FIG. 5 in unlocked position;

DETAILED DESCRIPTION OF THE INVENTION

Figure 1:
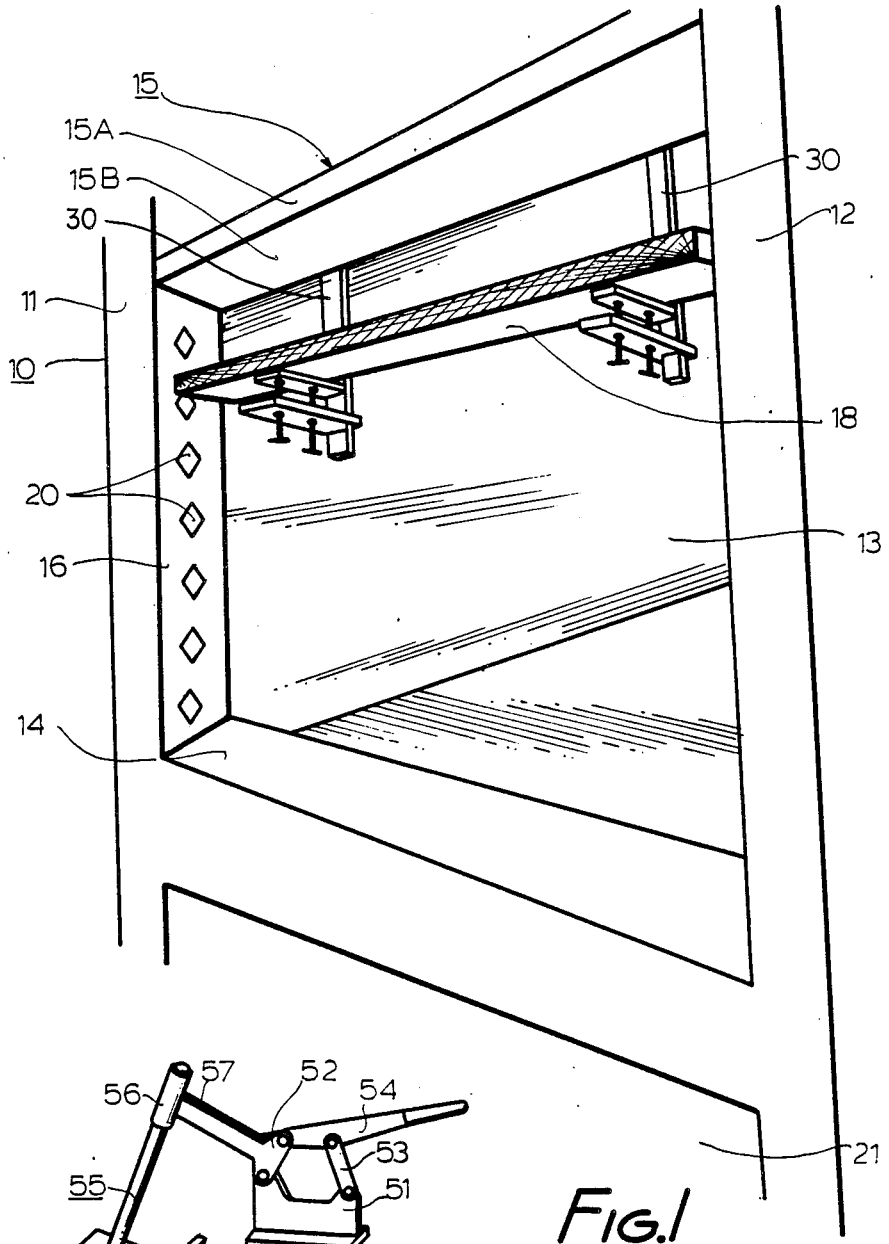
FIG. 1 is a fragmentary perspective view of a building under construction and using the hanger and method of this invention.

Referring now to FIG. 1, a fragmentary section of a building 10 under construction is illustrated with this invention in use. The building is of structural steel construction employing columns 11 and 12, in this case defining window opening 13 between the sill 14 and a window support lintel 15. The columns 11 and 12 may be H beams in form but often have inner studs 16 which may be channel shaped including lightening holes 20. The support lintel 15 is typically a channel formed of sheet steel with the legs 15A extending upward. The base 15B of the support lintel 15 defines the structural upper limit of the window opening 13.

Figure 6:
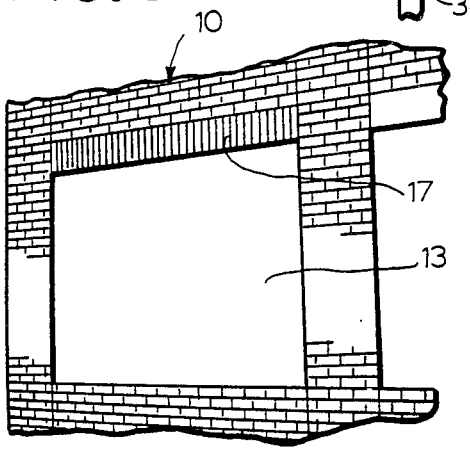
FIG. 6 is a fragmentary perspective view of a finished building construction using this invention.

The structure of FIG. 1 is nearly ready for the use of this invention for installing the top soldier bond or rowlock bond course 17, appearing in FIG. 6 in the window opening 13. Prior to the actual laying of the top course, the face bricks covering the columns 11 and 12 and the wall portion 2 are laid for example in stretcher bond as illustrated in FIG. 6. Reference should be made to FIG. 6 to show the finished facing of the window opening 13 after all the courses of bricks plus the window top course of soldier bond bricks has been laid. In the partial window opening of FIG. 6, for illustration purposes, a precast or stone one-piece lintel is shown. In normal construction all decorative lintels will match but to illustrate that this invention is equally useful for one-piece decorative lintels, one has been shown in FIG. 6 next to the soldier course 17.

Again referring to FIG. 1, secured to the channel shaped support lintel 15 and extending into the window opening 13 are a pair of hangers 30 in accordance with this invention supporting a plank 18. These hangers 30 are positioed generally toward the opposite ends of the window opening 13. If the window opening 13 is over six feet in length, three hangers of the type 30 are recommended, an additional one being in the center. The hangers 30 are secured to the building at the interior and do not extend outward beyond the face of the building so that all exterior work activity can be conducted without interference due to the presence of these hangers 30.

Figure 7:
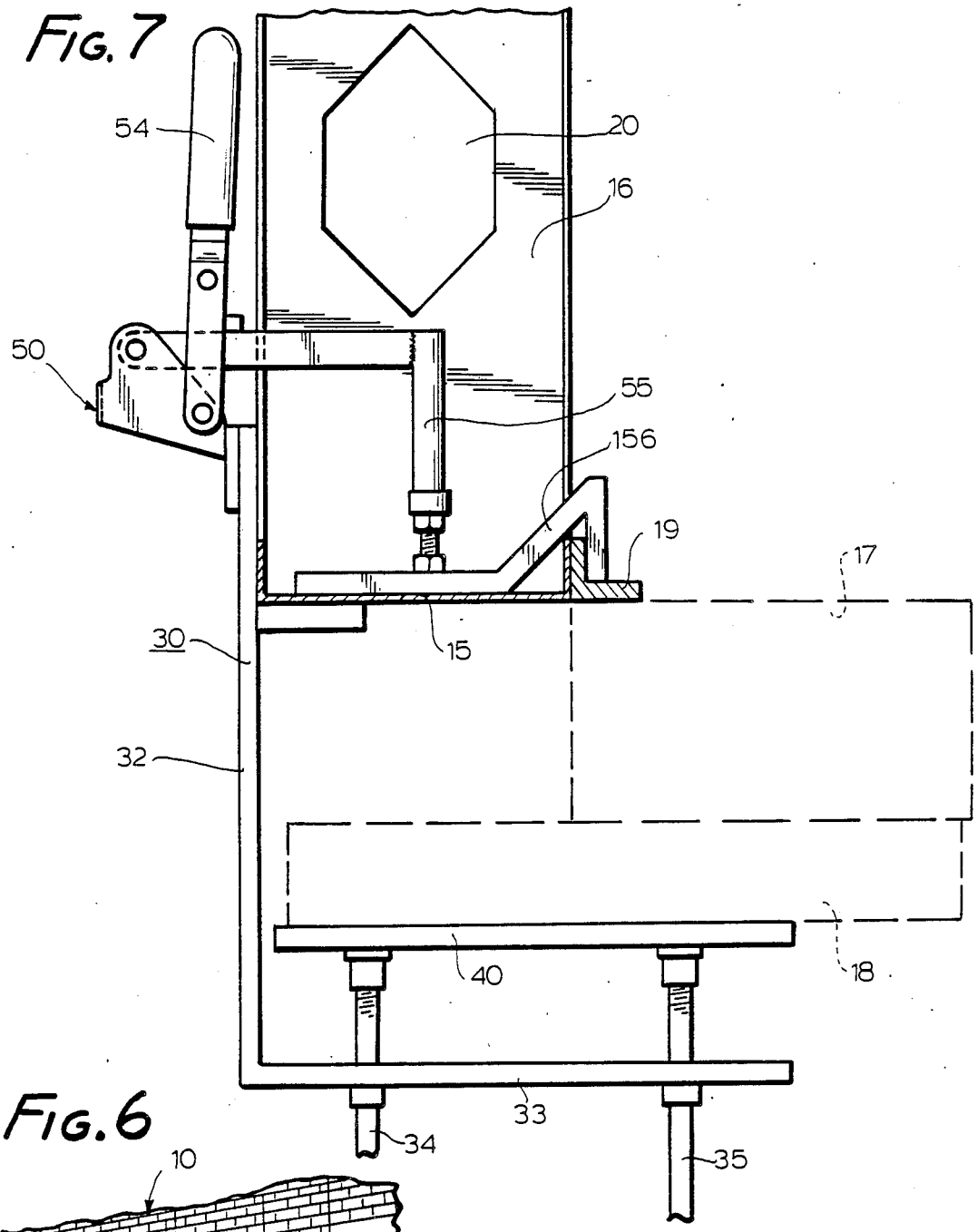
FIG. 7 is a side elevational view of an alternate embodiment of this invention with portions of the building, brick and support beam shown in phantom.

The hanger 30, typical of the hangers of this invention, is more clearly shown in FIGS. 2 through 5 to which reference is now made. Now referring to FIGS. 2–5, the hanger 30 includes a main body member 32 generally in the shape of an L with a foot section 33 extending outward approximately 10 to 12 inches or the equivalent of the largest brick expected to be used. The foot 33 has a pair of adjusting screws 34 and 35 with their respective handles 36 and 37. The adjusting screws 34 and 35 move a support plate 40 upward and downward as the screws 34 and 35 are adjusted. The L shaped foot 33 may be fixedly connected to the body for simplicity but less flexibility, as is illustrated in FIG. 7. In the preferred embodiment of FIGS. 2–5, the foot 33 includes a slot through which the body member 32 passes. The foot 33 is secured in one of a series of notches 42 in the body member 32 by a set screw 43. The notches 42 provide a broad range of basic adjustments to the foot 33, and a smaller degree of adjustment in the level of support plate 40 is afforded by the screws 34 and 35.

The three notches 42 are usually adequate to provide the flexibility needed in this device for the different size of brick and for orientation of whether the top course 17 of FIG. 6 will be soldier bond or rowlock bond (vertical or horizontal). The foot 33 is adjusted to the most nearly correct slot 42, and the set screw 43 is tightened. Thereafter, adjustments in height and angularity of the plate 40 are made by the screws 34 and 35.

Fixed to the body 32 is an L shaped step 44 designed to rest underneath the channel shaped support lintel 15 of FIG. 1. By resting on the inner leg and lower web of the channel 15, the hanger of this invention is positioned at the precise height desired for supporting the plank 18 which in turn supports the top course of bricks during the laying operation. In FIG. 5, the course 17 to be laid and the plant 18 are shown in phanton.

Referring now to FIGS. 5 and 5A, a clamping assembly generally designated 50 includes a clamp base 51 and a pair of links 52 and 53 connected to a clamp handle 54 which controls the movement of a clamp arm 55 including a clamp foot 56. The clamp foot 56 is adjustable in downward position by means of threaded engagement of the clamp arm 55 with an internally threaded tubular portion 58 of the clamp camming member 57. With the handle 54 in the position shown in FIG. 5A, the clamp arm 55 is disengaged. With the clamp handle 54 in its vertical position as illustrated in FIG. 5, the clamp foot is fully engaged with the inner wall of the channel 15 and its inner leg 15A. This clamping action provides the rigidity necessary to insure that the top course 17 is laid securely. Ties 25, appearing in FIG. 5, aid in support.

Figure 2A:
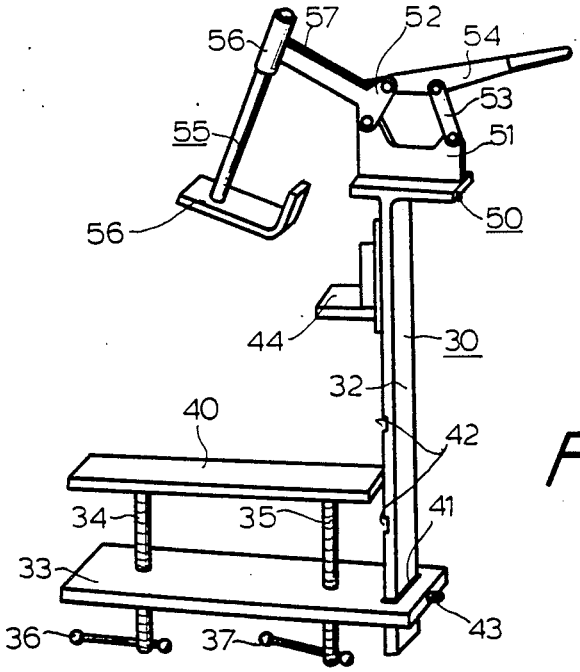
FIG. 2A is a perspective view of an alternate embodiment of this invention.

Now referring to FIG. 2A, I have found that in many building, the framework provides a vertical surface inside the building of sufficient proximity and strength that hanger 30 of this invention may be temporarily supported by a single self-tapping screw or in some cases two such screws will provide more than adequate support for the hanger.

In FIG. *2a*, the hanger 30 includes the body member 32 and foot member 33 and support plate 40 as well as adjusting screws 34 and 35. The hanger of this embodiment need not have the clamping assembly as shown in FIGS. 2–5. Instead it has a plurality of holes 60 extending through its flat face for receiving mounting screws which are driven from the rear(right hand side in the drawing) into the adjacent framework (unshown) but generally corresponding to the inside leg 15A of the support lintel 15 of FIG. 5. Whenever this embodiment may be used, it is preferred, because of its simplicity and lesser cost than the clamp assembly. In those locations where the support lintel 15 is available as shown in FIGS. 2–5, and screw attachment is not practical, the embodiment of FIGS. 2–5 is preferred.

Figure 2:
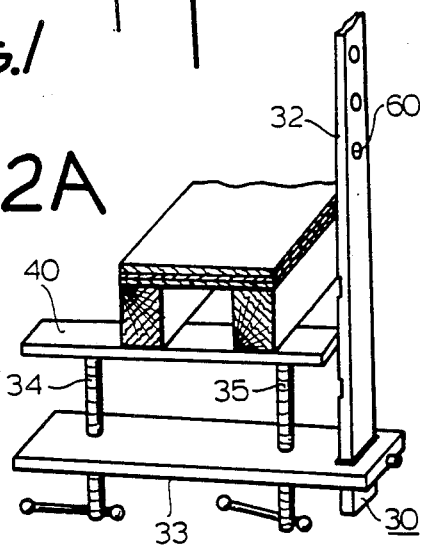
FIG. 2 is a perspective view of the hanger of this invention.

In the embodiment of FIG. 2 as shown, the hangers 30 engage the support lintel 15, however side clamping hangers are possible with the clamp 50 mounted on the side of hanger 30.

Also in accordance with this invention, in FIG. 7 the hanger 30 may be secured to the front wall of the support lintel 15 and more particularly to the angle shelf 19 which is welded to support lintel 15. In this case, a clamp foot 156 in the form of a modified Z holds the clamp 30 to the support lintel 15 and foot 156. This embodiment of the invention may be used but is not preferred since the clamp foot 156 extends into the work area and temporarily limits the masons in commencing the bottom course of the next story. The embodiment of FIGS. 2–5 is totally within the structure when installed and allows exterior work to continue unimpeded.

In accordance with the method of this invention, a hanger is secured to the lintel of a window or other opening in a masonry or other type of curtain wall building with the hanger extending into the window opening. A lateral support is placed on the hanger and adjusted upward to one brick plus mortar spacing from the underside of the support lintel to the support. The top course is laid on the support and after the mortar sets, the support may be removed. During the process, construction may continue on both the exterior and interior of the building.

The above described embodiments of this invention are mrerely descriptive of its principles and are not to be considered limiting. The scope of this invention instead shall be determined from the scope of the following claims, including their equivalents.

What is claimed is:

1. A hanger for use during construction for supporting a masonry or ornamental lintel for window or lintel openings in a building framework having an exterior and an interior including a support lintel and columns and still defining the window or lintel opening and designed for an exterior of masonry veneer comprising:

a generally elongated body member adapted for upright hanging on a building framework from the interior thereof and extending downward from above into the window or lintel opening in the framework;

means for temporarily securing said elongated body member to the framework above said window or lintel opening;

support means for a masonry or ornamental lintel during installation comprising a first generally horizontally extending member cantilevered into the window opening means securing said first generally horizontally extending member to said elongated body member;

a second generally horizontal member for supporting either the masonry or an ornamental lintel or a plank-like form for supporting brick or other masonry while being laid at the top of the opening; and means for adjusting the spacing between said first and second generally horizontal members to provide precise positioning of the masonry or ornamental lintel.

2. A hanger in accordance with claim 1 wherein said securing means comprises a clamp securable to the inside of said framework above said window or lintel opening.

3. A hanger in accordance with claim 1 wherein said adjusting means adjusts the spacing and relative angle of said first and second members whereby the location and angularity of the ornamental lintel or bricks or other masonry at the top of the opening may be adjusted.

4. A hanger in accordance with claim 1, 2 or 3 in which said adjusting means comprises a pair of spaced screw adjustments.

5. A hanger in accordance with claim 1 wherein said first generally horizontal member is adjustable in a vertical direction with respect to said elongated body member.

6. A hanger in accordance with claim 1 including a stop means on said elongated body member engagable with the framework of the building for positioning the elongated body member at a predetermined distance below the portion of the building framework defining the top of the window or lintel opening.

7. A hanger in accordance with claim 6 wherein said stop means extends into the opening in the framework on the opposite side of a section of said framework from said clamp means to engage said localized section of said framework on both sides thereof whereby said stop means cooperates with said securing means to temporarily secure said hanger to the framework of the building.

8. A device for aiding in the laying of a top rowlock course of bricks or other ornamental lintel materials in a window or lintel opening defined by a building framework of angled configuration with a surface of said framework defining the top of a window opening comprising:

clamp means for temporary securement to the framework member defining the top of the window or lintel opening with said clamp means extending above the window or lintel opening; and hanger means securable to said clamp means to extend below the top of the window or lintel opening and cantilevered at least partly into the window or lintel opening from the interior of the building framework;

whereby elongated support means such as a plank may be placed on said hanger means to provide a support for the top rowlock course of bricks, or lintel material may be carried by a pair of said hangers in the window or lintel opening to allow the laying of the top course and the setting of mortar between the brick without interference with construction either to the exterior or interior of the building framework.

9. The device in accordance with claim 8 wherein said clamp means comprises a body member engagable with the framework on the interior side of the framework and a clamping member movably engaging the body of the clamp for movement into or out of engagement with a portion of the framework member;

a hanger securable to said body;

said hanger extending below the top of the window or lintel opening for holding a lateral support for the top course of bricks or lintel material while being laid and during the curing of the mortar.

10. The combination device in accordance with claim 9 wherein said clamping member comprises an overcenter lock.

11. The device in accordance with claim 8 in which the framework comprises a metal channel and said clamping means inludes a foot conforming to the shape of a portion of said metal channel.

* * * * *